US007436318B2

(12) United States Patent
Affolter et al.

(10) Patent No.: US 7,436,318 B2
(45) **Date of Patent: *Oct. 14, 2008**

(54) SELF CONTAINED DEVICE FOR DISPLAYING ELECTRONIC INFORMATION

(75) Inventors: Allen Affolter, Indiana, PA (US); Titus Mathews, Calgary, CA (US)

(73) Assignee: ATG DesignWorks, LLC, Indiana, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/774,670

(22) Filed: Jul. 9, 2007

(65) Prior Publication Data

US 2008/0012721 A1 Jan. 17, 2008

Related U.S. Application Data

(63) Continuation-in-part of application No. 10/828,406, filed on Apr. 19, 2004, now Pat. No. 7,242,315.

(51) Int. Cl.
*G08B 5/22* (2006.01)

(52) U.S. Cl. ..... 340/815.83; 434/317; 345/169

(58) Field of Classification Search ..... 340/815.83; 257/99; 434/317, 308, 309; 361/681; 345/169, 345/156, 901

See application file for complete search history.

(56) References Cited

U.S. PATENT DOCUMENTS 4,656,469 A 4/1987 Oliver et al.
4,855,725 A * 8/1989 Fernandez ..... 345/173
5,531,600 A 7/1996 Baer et al.
5,532,711 A 7/1996 Harris
5,534,888 A * 7/1996 Lebby et al. ..... 345/672
5,538,430 A 7/1996 Smith et al.
5,761,485 A 6/1998 Munyan
6,021,306 A 2/2000 McTaggart
6,130,773 A 10/2000 Jacobson et al.
6,396,472 B1 5/2002 Jacklin
6,416,326 B1 * 7/2002 Oh ..... 434/178
6,481,851 B1 11/2002 McNelley et al.
6,490,402 B1 12/2002 Ota
6,597,111 B2 7/2003 Silvernail et al.
6,614,057 B2 9/2003 Silvernail et al.
6,624,568 B2 9/2003 Silvernail
6,763,995 B1 7/2004 Song
6,788,283 B1 9/2004 Blotky et al.
6,897,850 B2 5/2005 Sugimoto
7,242,315 B2 * 7/2007 Affolter et al. ..... 340/815.83
2001/0040560 A1 11/2001 Amron

FOREIGN PATENT DOCUMENTS

DE 3515897 12/1986

OTHER PUBLICATIONS www.universaldisplay.com; Product Concepts; Nov. 7, 2003.
www.neasia.nikkeibp.com; Packaging Made Smart with Paper-Thin Battery; Nov. 4, 2003.

* cited by examiner

*Primary Examiner*—Anh V La
(74) *Attorney, Agent, or Firm*—Emerson, Thomson & Bennett, LLC; Roger D. Emerson; Daniel A. Thomson

(57) ABSTRACT

A thin flexible electronic display includes a flexible membrane, control circuitry, and self-contained power source, which may be a thin flexible battery. A display may be affixed to an associated device for use in displaying dynamic information or video.

21 Claims, 8 Drawing Sheets

SELF CONTAINED DEVICE FOR DISPLAYING ELECTRONIC INFORMATION

This U.S. utility patent application is a continuation-in-part of, and claims priority to, U.S. Ser. No. 10/828,406, filed Apr. 19, 2004, which is now U.S. Pat. No. 7,242,315, issued Jul. 10, 2007.

BACKGROUND OF THE INVENTION

A. Field of Invention

This invention pertains to the art of methods and apparatuses of displaying information on a thin, flexible display and more specifically to displaying dynamic video in a magazine or periodical.

B. Description of the Related Art

It is known in the art to publish various types of documents such as periodicals, magazines, manuals and the like. Typically, such published documents are printed on flexible pages, which may be comprised of varying paper thicknesses or weights. As is well known in the art, frequently pictures and/or words are arranged on the individual pages of the published document, which may be bound together at a binding. In any case, such published documents are widely known and publicly available for purchase on numerous topics. In a similar manner, instruction manuals are frequently printed with images and/or verbiage for use in guiding a user, for example, through a set up procedure for a purchased item. In all of these printed documents, the data displayed thereon is purely static in that the images do not move but rather are displayed in the typical form as is well known in the art. There are limitations of the static information printed on a flexible page to convey information to the user or viewer. Therefore, it would be useful to convey dynamic information in the form of video and/or audio signals to the user viewing a periodical, magazine, or instruction manual.

The present invention provides methods and apparatuses for displaying such dynamic information in a flexible periodical or manual.

SUMMARY OF THE INVENTION

One aspect of the present invention includes a method for displaying information in a magazine, the steps comprising: providing one or more adjacent flexible pages bound together at a binding; providing a flexible self-contained information displaying means, the self-contained information displaying means including: an electronic display membrane, control circuitry operatively communicated to the electronic display membrane for use in electronically displaying information on the electronic display membrane, and, at least a first power cell operatively communicated to the control circuitry and display membrane for use in supplying power to the control circuitry; affixing the electronic display membrane to one of the flexible pages; and, automatically displaying at least a first electronically preprogrammed information message on the electronic display membrane.

Another aspect of the present invention includes a step of providing a flexible self-contained information displaying means, the self-contained information displaying means further comprising: a sensor for use in determining the proximity of a flexible page; and, wherein before the step of automatically displaying at least a first electronically preprogrammed information message on the electronic display membrane, the step further comprising: sensing the turning of a flexible page adjacent to the electronic display membrane.

Another aspect of the present invention includes a step of: affixing the control circuitry to the binding.

Another aspect of the present invention includes a step of: affixing the control circuitry to one of the flexible pages.

Another aspect of the present invention includes a step of providing a flexible self-contained information displaying means further includes: electronic information storage means.

Another aspect of the present invention includes a step of: selectively communicating the electronic information storage means to the control circuitry.

Another aspect of the present invention includes a step of selectively communicating the electronic information storage means to the control circuitry, the step further comprising: preprogramming the electronic information storage means.

Another aspect of the present invention includes a step of providing a flexible self-contained information displaying means, the self-contained information displaying means further comprising: an electronic data receiving port operatively communicated to the control circuitry; and, further comprising the step of: selectively operatively communicating the electronic information storage means to the control circuitry, and, programming the electronic information storage means via electronic data receiving port.

Another aspect of the present invention includes a magazine, comprising: at least first and second flexible pages bound together at a binding; a thin electronic display membrane fixedly attached to the first flexible page; electronic control circuitry operatively communicated to the electronic display membrane; at least a first power cell operatively communicated to the electronic control circuitry for use in supplying power to the electronic control circuitry.

Another aspect of the present invention includes a magazine, further comprising: electronic information storage means selectively removable with respect to the electronic control circuitry.

Another aspect of the present invention includes a magazine, further comprising: user interface means operatively communicated to the electronic control circuitry.

Another aspect of the present invention includes a magazine, further comprising: sensor means for use in determining the proximity of the at least a first flexible page with respect to the at least a second flexible page.

Another aspect of the present invention includes a magazine, further comprising: audio transmitting means operatively communicated to the electronic control circuitry.

Another aspect of the present invention includes a magazine, wherein the audio transmitting means is a speaker.

The present invention utilizes an apparatus and claimed methods for a flexible display membrane, and affixing the flexible membrane to various items. In one embodiment, the display includes a membrane which is flexible and which may be affixed to the page as mentioned. Subsequently, the display may include control circuitry also fashioned in a flexible manner and a power source again which may be thin and flexible all of which may comprise the basic flexible display. Additional items may be included in the display including the communications port sensor means and audio transmitting means. The display may be affixed to the page of a periodical as mentioned for use in displaying dynamic information or video. Preprogrammed video messages may be stored in the memory of the control circuitry or display on the flexible membrane.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

DESCRIPTION OF THE INVENTION

Figures 1, 1A:
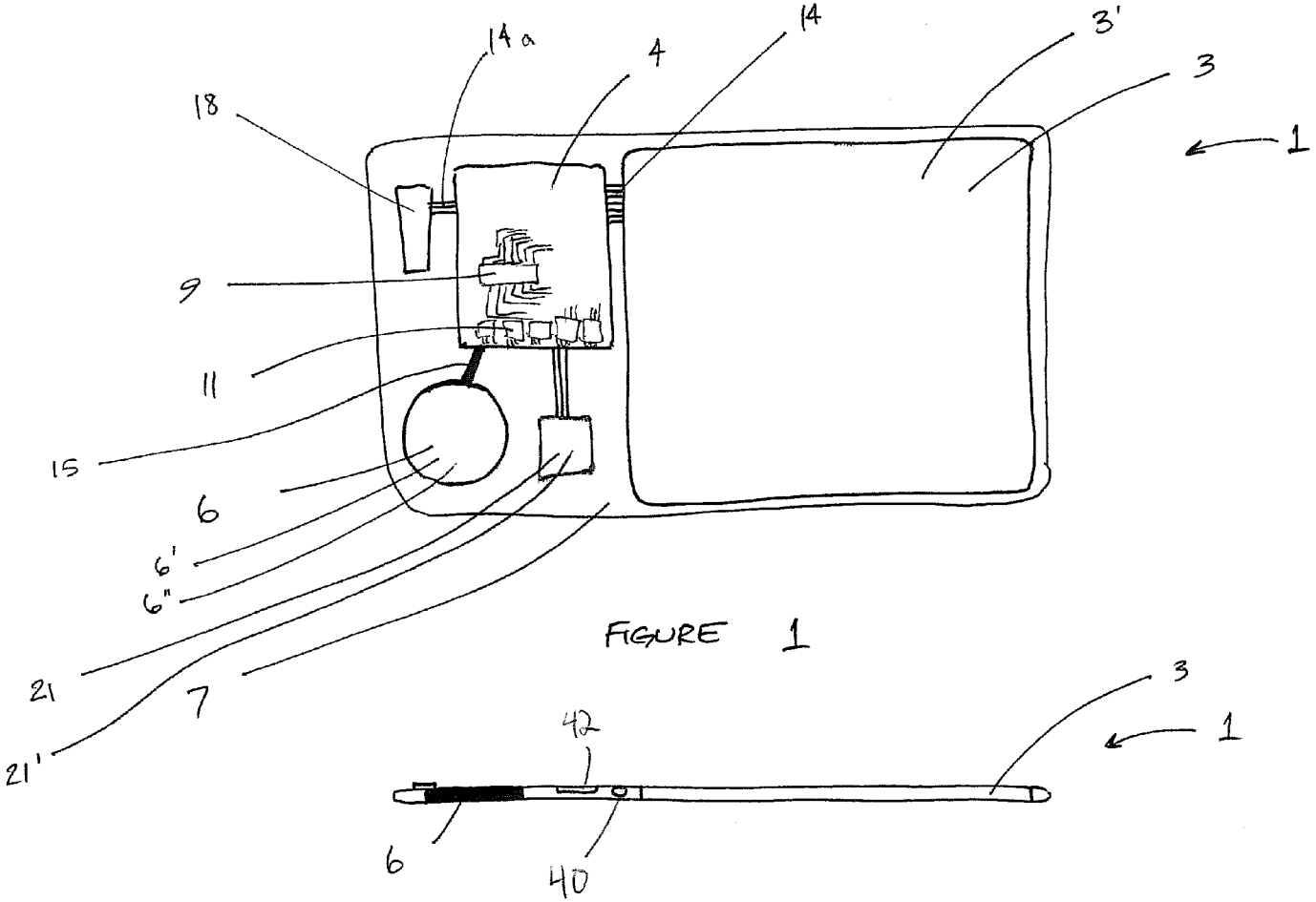
FIG. 1 is a plan view of the flexible electronic display.
FIG. 1*a* is a side view of the flexible electronic display.

Referring now to the drawings wherein the showings are for purposes of illustrating at least one embodiment of the invention only and not for purposes of limiting the same, FIG. 1 shows a self-contained electronic displaying device shown generally at 1. The self-contained electronic displaying device 1 may include a display portion 3, electronic control circuitry 4 and a power source 6. The device components may be completely contained within the device 1. That is to say that the device components may form a unitary part. In one embodiment, the unitary device may be contained within a flexible sheath 7. Alternately, each of the display components may be individually contained within separate discrete sheaths 7', as will be discussed in detail in a subsequent paragraph. In any embodiment, the display portion 3 may be electrically communicated to the electronic control circuitry 4, which may control how the information is displayed on the display portion 3. Additionally, the power source 6 may be communicated to the control circuitry 4 and/or display portion 3 for use in providing power to operate the device 1. In this way, the electronic displaying device 1 is self-contained in that it does not require a separate power source or external circuitry to display information on the device 1.

With continued reference to FIG. 1 and now to FIG. 1*a*, the electronic displaying device 1 may be a thin flexible electronic displaying device 1 wherein the electronic displaying device 1 may be resiliently deformable when flexed. That is to say that the self-contained electronic displaying device 1 may be bent back and forth without permanently affecting the displaying characteristics of the self-contained electronic displaying device 1. In this manner, the display portion 3 may also be constructed as a flexible display member 3' wherein information stored in the electronic control circuitry 4 may be selectively depicted on the flexible display member 3'. In one embodiment, the display portion 3 may be an electronic display membrane 3. The display membrane 3 may be thin with respect to the width and length of the electronic display membrane 3. By thin it is generally meant that the thickness of the electronic display membrane 3 may be at least an order of magnitude smaller with respect to the display's width and length. For example, a display membrane having a length of 7 inches or greater may have a thickness of 0.25 inches. It is contemplated in an alternate embodiment that the membrane 3 may have smaller lengths while still having a thickness of 0.25 or smaller. However, any length and/or thickness of membrane 3 may be chosen with sound engineering judgment as is appropriate for use with the subject invention. The electronic display membrane 3 may also be constructed as an optoelectronic device that emits light in the presence of electric current. One such example of the optoelectronic device is an organic light emitting device or OLED. The OLED may be constructed from two or more organic light-emitting material layers fashioned between electrical conductors. When a voltage difference is applied to the conductors, light is emitted from the organic light-emitting material layers, forming a picture element or pixel. Aligning an array of pixels may therefore form a display region or screen. One characteristic of the OLED display screen is that the screen may be flexible and selectively conformed to a curved or contoured surface. In that OLED displays are known in the art, no further explanation will be offered at this time. It is noted that while an OLED display may be used in the subject invention, it is understood that any flexible and substantially thin electronic display may be used without departing from the nature of the subject invention. In another example of an electronic or electrical display membrane 3, the membrane 3 may include individual lights or light emitting means, which may be LEDs that are arranged individually or in an array pattern for displaying information or for attracting attention. In this way, the lighting emitting means may be controlled by the control circuitry 4 and be supplied with power from a power source, as will be discussed further in a subsequent paragraph. However, any light emitting means may be chosen with sound engineering judgment as is appropriate for use with the subject invention.

With continued reference to FIGS. 1 and 1*a*, control circuitry 4 may be communicated to the electronic display membrane 3. The control circuitry 4 may be comprised of a logic processing unit 9 and memory 11. The memory 11 may include dynamic or static memory, one-time programmable or re-programmable memory, fixed or removable memory, or storage means of any type chosen with sound engineering as is appropriate for use with the subject invention. Additionally, the logic processing unit 9 may include a microprocessor and/or any support peripheral circuitry chosen with sound engineering judgment. The control circuitry 4 may similarly be constructed on a thin flexible material by electrically connecting judicially distributed circuit components mounted on said flexible material. Electrical circuits of this type may be constructed on a flexible material (such as polyester) onto which a thin conducting layer (such as copper) has been robustly attached, forming a 'flexible substrate'. Circuit paths may then created by removing unwanted conductor; one means of doing so is by depositing on the conducting layer a masking material in the desired pattern and then exposing the substrate to a chemical that etches away the conductor where there is no masking material. Multilayered substrates may be formed, for example, by layering substrates so constructed, and then electrically connecting the different layers through, for example, drilled holes and the subsequent selective deposition of more conducting material. Circuit components may then be attached in an electrically conductive manner, for example through soldering. Before and/or after components are attached, protective coatings/layers may be applied to the entire assembly. It is also noted that any method of creating a flexible electronic circuit may be chosen with sound engineering judgment. It is also noted that the construction of flexible circuits is well known in the art. Extended from one area of the control circuit may be a communication bus 14 that is connected to electronic display membrane 3. Data from the control circuit memory 11 may be selectively communicated to the display membrane 3 for use in displaying a message on the display membrane 3. The information displayed on the membrane 3 may be one or more static images or dynamic video, or static or dynamic patterns previously stored in the memory 11 prior to activation of the device 1 as will be discussed further in the following paragraphs. Additionally, the membrane 3 may be monochrome or color. Either may be chosen for displaying information as controlled by the control circuitry 4 of the electronic displaying device 1.

With reference again to FIGS. 1 and 1*a*, in one embodiment, the power source 6 or power cell 6 may be substantially thin to be received with the sheath 7 of the device 1. The power source 6 may be a thin battery 6' or a photoelectric cell 6". The battery 6' may be a solid state thin film battery 6' having characteristics similar in size, weight and configuration to paper. Such batteries 6' may be flexible and substantially thin for use in providing power to the subject invention. The batteries 6' may also be rechargeable. In an alternate embodiment, the power source may incorporate a photocell or a solar cell that generates electrical power when exposed to light and/or the sun. In this way, electrical power may be stored and transmitted to the control circuitry 4 and display membrane 3. It is noted that while the power cell 6 may be rechargeable, the power cell 6 is generally a limited capacity power source having a predefined capacity for storing energy. In this manner, the power cell 6 may be a portable power cell 6. It is understood that any type of thin and flexible power source may be chosen with sound engineering judgment including but not limited to combinations of the aforementioned embodiments. The power cell 6 may be communicated to the control circuitry 4 or display portion 3 or any portion of the device 1 via power supply conductors 15 or any means chosen with sound engineering judgment.

With reference once again to FIGS. 1 and 1*a*, the device 1 may include a communication port 18. The communication port 18 may be communicated to the electronic control circuitry 4 via secondary communication bus 14*a* constructed in a manner similar to that as described above. However, any manner of constructing communication buses may be chosen with sound engineering judgment that is appropriate for use with a flexible and thin electronic display device 1. The communication port 18 may be directly connected to the control circuitry for use in reading electronic information from and writing electronic information to one or more portions of the control circuitry 4. In this manner, data comprising the information displayed on the display membrane 3 or data used in controlling how the information is displayed on the display membrane 3 may be read or written in any manner consistent with operation of the subject control circuitry 4. In this way, the communication may be used to program, or reprogram, the control circuitry 4 with different messages or different message displaying schemas.

With reference one again to FIGS. 1 and 1*a*, the electronic displaying device 1 may include a sensor or sensor means 21. The sensor means 21 may comprise a single sensor. However, sensor means 21 may also comprise one or more sensors forming a sensor array 21' functional to sense different conditions surrounding the electronic displaying device 1. In one embodiment, sensor means 21 comprises one type of sensor 21 that may detect the proximity of an object close to the sensor 21. One such object that may be detected by sensor 21 may be a page in a magazine. The sensor may be connected to the control circuitry 4 for use in determining when or how information stored in the control circuitry 4 is displayed on the display membrane 3 as will be discussed further in a subsequent paragraph. The sensor 21 may be connected to the control circuitry 4 in any manner chosen with sound engineering judgment. It is noted that any type, quantity and configuration of sensors may used with the subject invention including but not limited to light sensitive sensors, pressure sensors, proximity sensors, motion sensors and the like. Additionally, any size and shape of sensors may be chosen with sound engineering judgment that is sufficiently thin for use with the electronic displaying device 1. In one embodiment, sensor means 21 may include a touch sensitive display screen 3" or pressure sensitive sensor covering the top face of the display membrane 3 for use as a user interface. In this way, the display membrane 3 may utilize programmable softkeys that function to interact with the user. As shown in FIG. 1*a*, the device 1 can have a headphone jack 40, which enables the user to insert a set of headphone (not shown) into the device 1. In one embodiment of this invention, the device could also have a port 42 for inserting memory, such as a memory stick (not shown). The operation of memory ports are well known in the field, and will not be described further herein.

Figure 2:
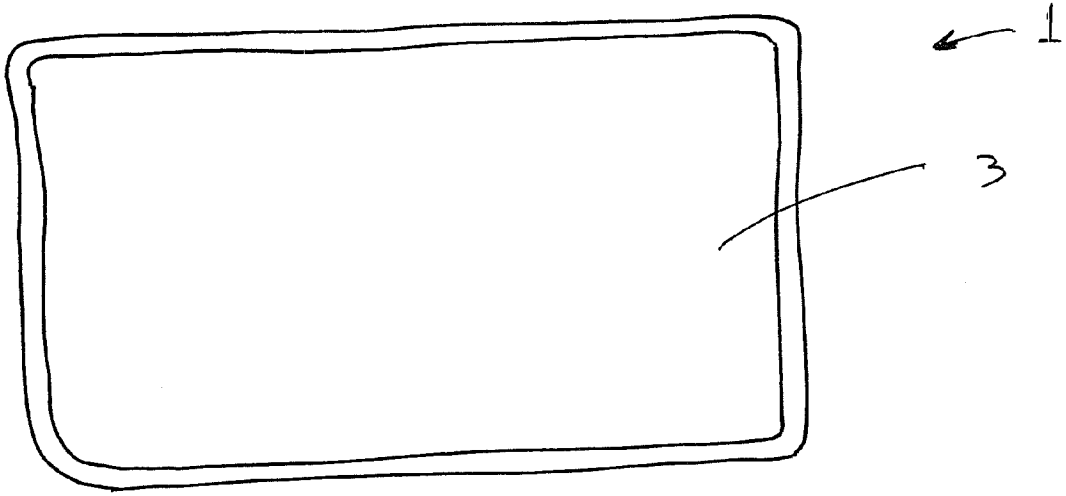
FIG. 2 is a plan view of an alternate embodiment of the flexible electronic display.
Figure 2A:
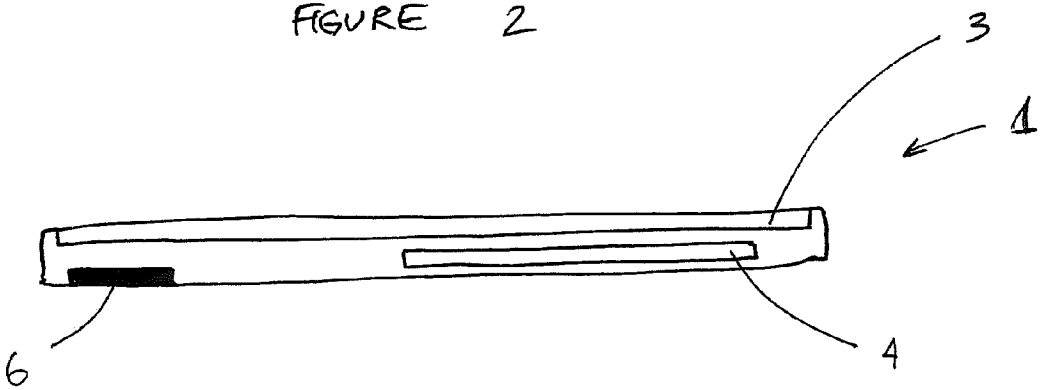
FIG. 2*a* is a side view of an alternate embodiment of the flexible electronic display.
Figure 3:
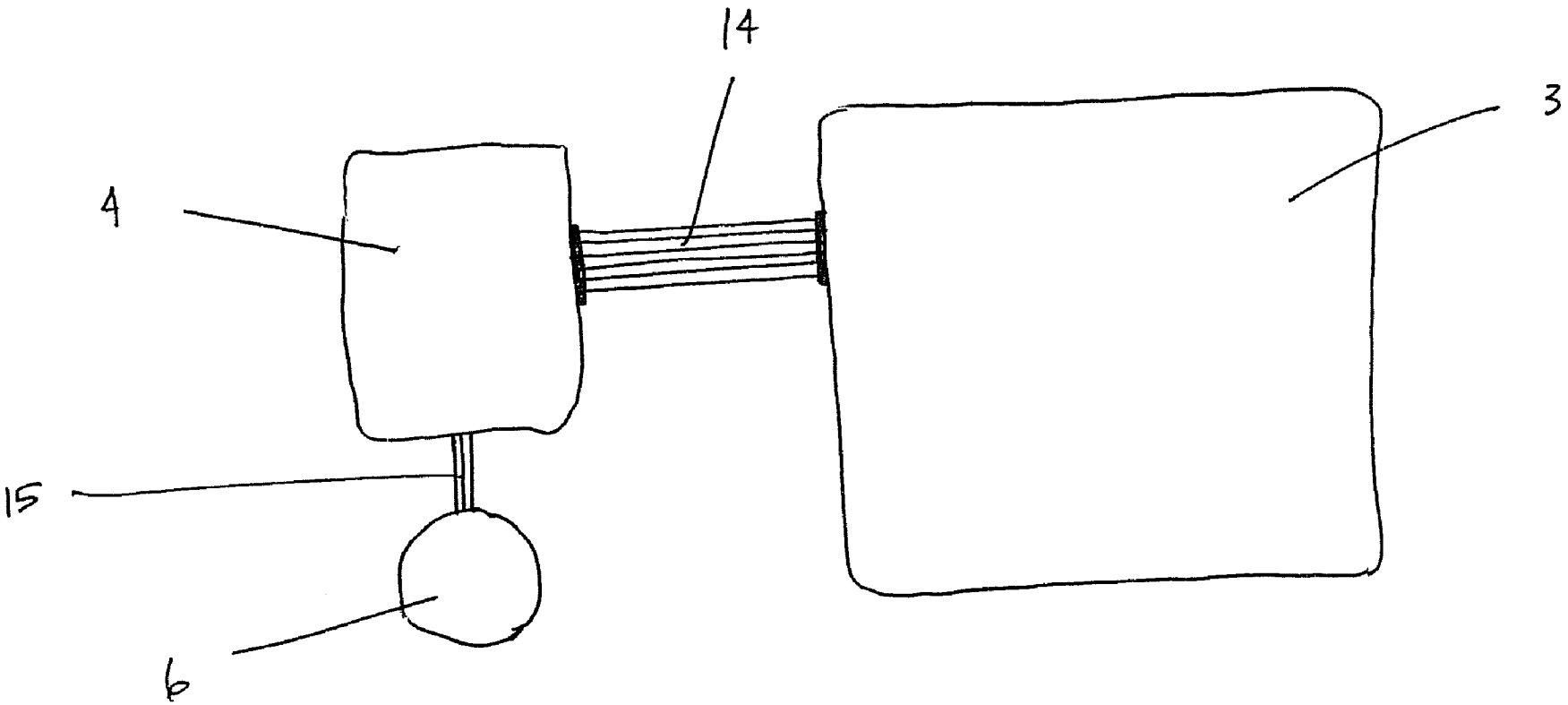
FIG. 3 is a plan view of yet another embodiment of the flexible electronic display.

With reference now to FIGS. 2, 2*a* and 3, alternate embodiments of the electronic displaying device 1 will now be discussed. As previously detailed, FIGS. 1 and 1*a* show the components of the device 1 juxtaposed to each other with respect to a common plane of reference. Alternately, FIGS. 2 and 2*a* show the display membrane 3 disposed in front of the control circuitry 4 and power cell 6. That is to say that the display membrane 3 is positioned in a different reference plane than the control circuitry 4 and power cell 6. In this way, the viewing area, i.e. length versus width, of the display membrane 3 is maximized by placing the remaining components behind the display membrane 3. This allows for a larger viewing display region to be used where the thickness of the display device 1 is not as critical. In this configuration, the display membrane 3, control circuitry 4 and power cell 6 are still contained in a single sheath 7 or unitary package. FIG. 3 shows yet another embodiment of the display device wherein the display membrane 3, control circuitry 4 and power cell 6 are not included in a single sheath 7 but are interconnected only via conductors 14, 15. In this manner, the display membrane 3 may be placed on a desired surface and the remaining components remotely positioned dependent upon the application. For example, the display membrane 3 may be conspicuously positioned on the exterior of a product and the control circuitry 4 and power cell 6 placed interior to the product packaging. However, it is noted that any configuration of the display device 1 and the components included therein may be utilized in a manner consistent with the present invention.

Figure 4:
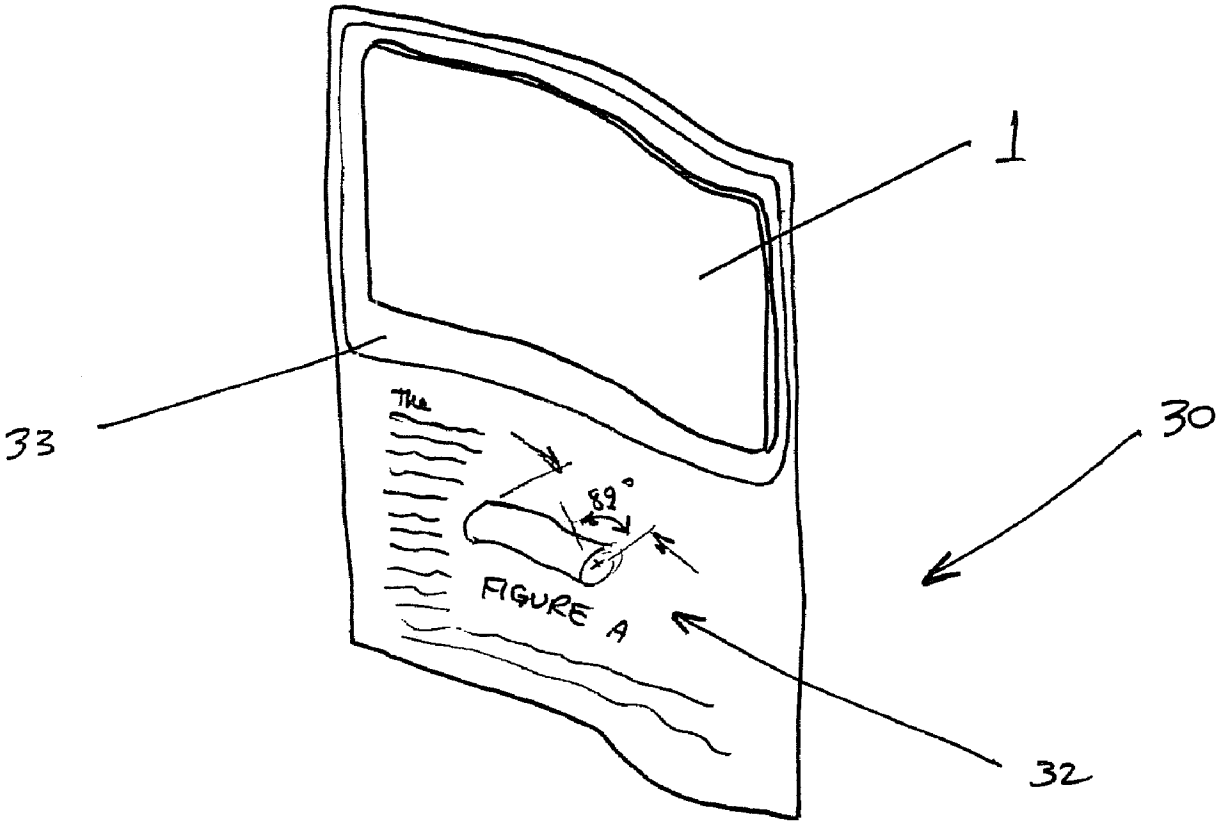
FIG. 4 is a perspective view of a flexible page including the flexible electronic display.
Figure 6:
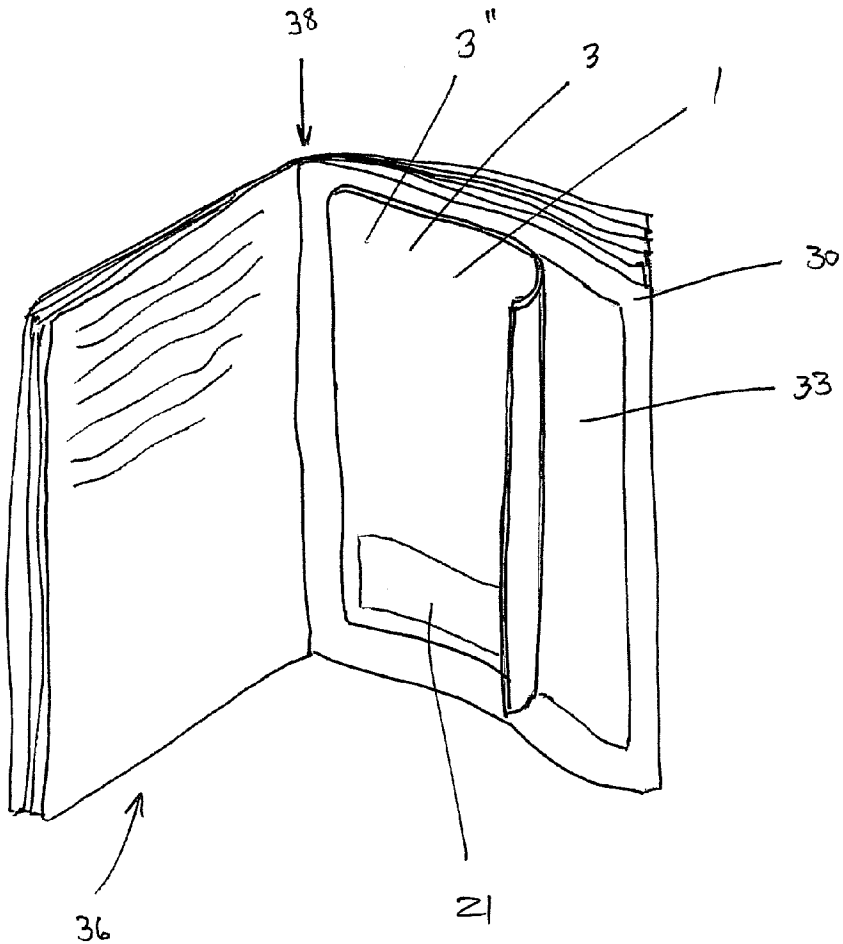
FIG. 6 is a perspective view of a flexible page including the removable electronic display.

With reference now to FIG. 4 and FIG. 6, a flexible page containing printed information is shown generally at 30. The information on the page 30 may comprise text, including words, symbols, and the like, as well as images or pictures as shown generally at 32. However, any information, images, pictures, etc. and/or combination thereof may be contained on a page 30 as is well known in the art. It is noted at this point that the page 30 may reside within or upon numerous items including but not limited to a magazine or magazine cover, pamphlet or single sheet brochure, instruction manual, instruction sheet, emergency exit display, menu, map/atlas, removable self contained "promotional" insert, informational insert, post card, envelopes, jewel case, folder label, bumper sticker, wallet picture/video display, product assembly instructions, video sports cards, pin-on buttons, products (as product labels, such as soup can labels), and the like. It is understood that magazine may refer to any general booklet type item that has pages contained therein and held together at a central binding, wherein the binding may include any means for holding the pages of the booklet together. Continuing, the electronic displaying device 1 may be affixed to a portion of the page 30. By affixed it is meant that the electronic displaying device 1 may be permanently or remove-ably placed on the page 30 wherein the electronic displaying device 1 is secured to the page via an adhesive or other means. By removably placed it is meant that electronic displaying device 1 may be selectively detached from the page 30 and placed in a different location for continued viewing. For example, the electronic displaying device 1 may be peeled off of the page 30 and placed elsewhere without affecting the self-contained electronic displaying device 1 display capabilities. Alternately, the electronic displaying device 1 may include a magnetic back for placing the electronic displaying device on a magnetically attracting surface for continued display. It is noted that any type of backing may be used on the electronic displaying device for use in remotely placing the device 1 as chosen with sound engineering judgment. This may be accomplished by securing the electronic displaying device 1 to a backing material 33 or by securing the electronic displaying device 1 directly to the page 30. However, it is noted that any means of affixed or securing the electronic displaying device 1 onto the page 30 may be chosen with sound engineering judgment including but not limited to fasteners, clasps, pins and the like. In this manner, the self-contained electronic displaying device 1 may be an integral part of the page 30 for use in dynamically displaying images, video, sound and the like directly on the page 30. That is to say that the page 30 with electronic displaying device 1 is portable and self-contained wherein there is no requirement for an external power supply to supply power to the device and wherein there is no external transmission of display data being sent to the electronic displaying device 1. In this way, the electronic displaying device 1 is self-contained. It is also noted that the membrane 3 may cover any percentage of the page 30 as chosen with sound engineering judgment. In FIG. 4, the membrane 3 is shown to span across the top portion of the page 30. However, in an alternate embodiment, the membrane 3 may be substantially the size of the entire page 30. Although, any size membrane 3 may be chosen with sound engineering judgment.

Figure 4A:
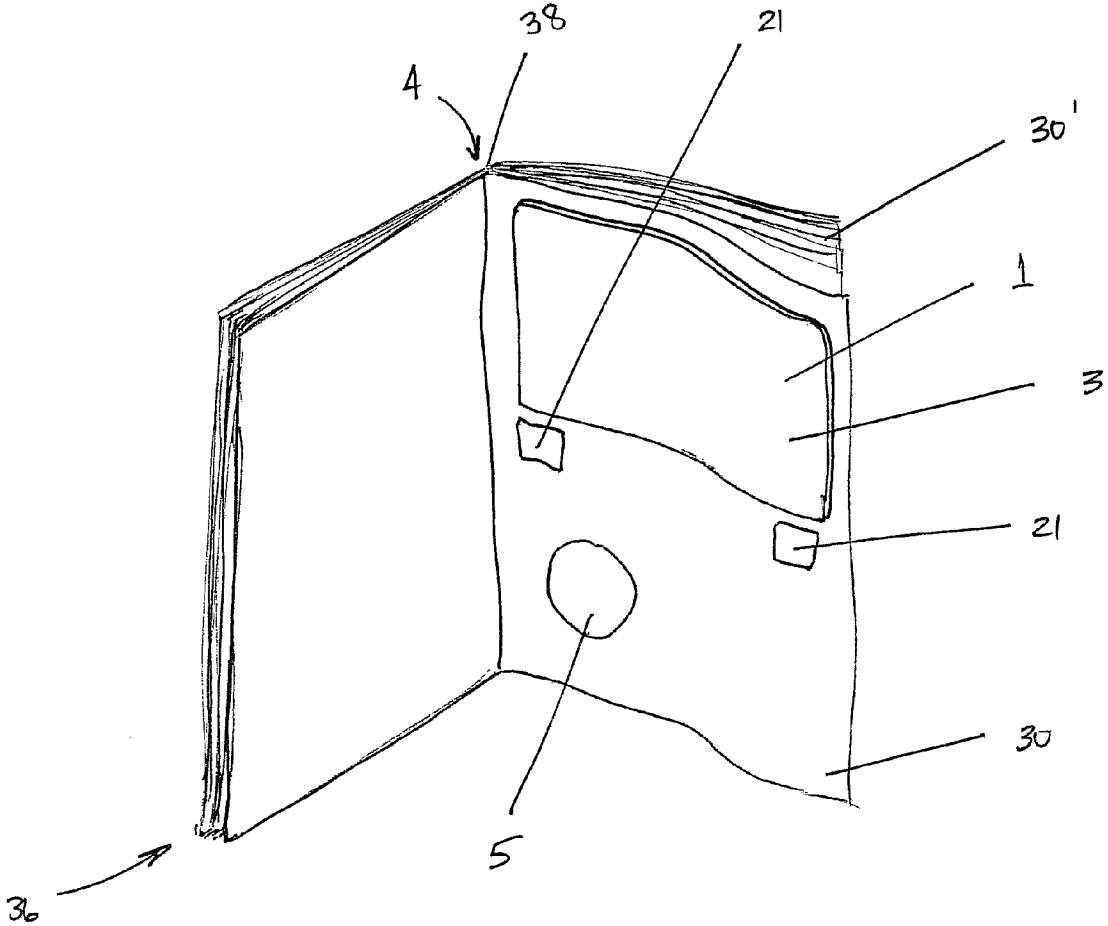
FIG. 4*a* is a perspective view of a periodical or manual having pages bound together and including a flexible electronic display affixed to one of the pages.

With reference to FIG. 4*a*, the electronic displaying device 1 is shown affixed to a page 30 wherein the page 30 is one of numerous pages 30' bound together at a binding 38, as in a periodical, magazine or instruction manual 36. In this embodiment, the electronic displaying device 1 may be affixed directly onto the page 30 bound in the periodical 36 or to a backing material 33 and then subsequently affixed to the page 30. Sensor means 21 may be positioned on the page 30 as well for use in determining when the pages 30' are turned with respect to the page 30 containing the electronic displaying device 1. In this manner, when an associated user/viewer of the periodical 36 turns the pages 30' of the periodical 36 to reveal page 30 containing the electronic displaying device 1, the sensor means 21 senses the opened page and may begin displaying the message contents of the electronic displaying device 1. It is noted the placement of the sensor means 21 may be placed anywhere on the page 30 as chosen with sound engineering judgment. The power source 6 and control circuitry 4 may be placed behind the membrane 3 adjacent to the page 30 or may be placed within the binding 38 of the periodical 36 to conceal the power source 6 and control circuitry 4 from the sight of the user/viewer. In an alternate embodiment, an audio transmitting means 5 may also be affixed to the page 30 or maybe affixed to the membrane 3. The audio transmitting means 5 may be a speaker 5' or any other audio transmitting device chosen with sound engineering judgment. In this way, the information displayed on the membrane 3 may be accompanied by audio signals controlled by the control circuitry 4 and powered by the power source 6. The audio signals may be preprogrammed to correspond directly to the displaying of information on the membrane 3. It is noted that the any manner, volume, timing, or the like of transmitting audio signals from the audio signal transmitting means 5 may be chosen with sound engineering judgment. It is also noted that the control circuitry 4 may be programmed to transmit audio signals at randomly chosen intervals for use in drawing attention to the periodical 36 if no activity has been sensed for predetermined amount of time. In this way, the electronic displaying device 1 may be preprogrammed to automatically display information on the membrane 3 and transmit audio information as initiated by the user/viewer.

Figure 5:
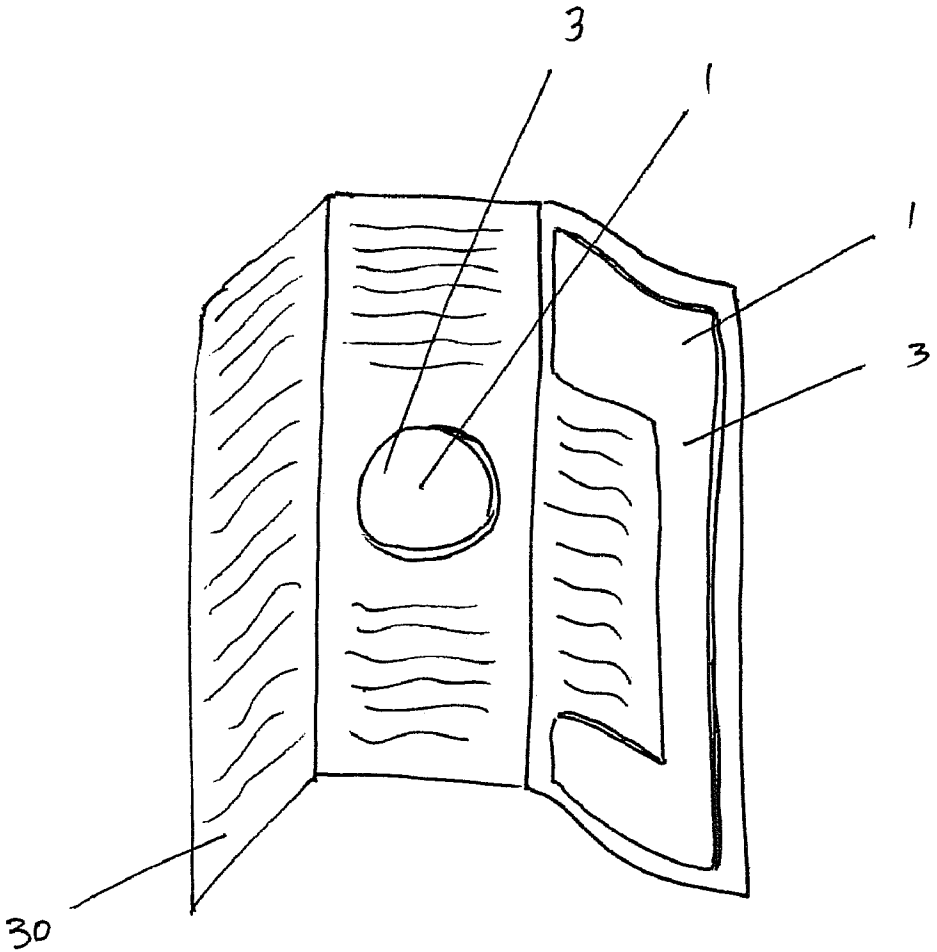
FIG. 5 is a perspective view of a flexible page including the flexible electronic display.

With continued reference to all of the FIGURES and especially to FIG. 5, as previously mentioned, the membrane 3 may be rectangular. The display membrane 3 may also be configured in alternate shapes such as circles, ellipses, squares and the like. Additionally, the display membrane may also be annular in configuration. That is to say that the display membrane 3 may be fashioned into a ring with no center. The display membrane 3 may also have a wedge shaped configuration. In this manner, the membrane may surround or outline part or all of existing information displayed or printed on a page 30 as previously discussed. Alternately, the display membrane 3 may include one or more separate sections communicated together but not formed as a single contiguous display. That is to say that there may be separate display membrane sections 3. It will be appreciated that the aforementioned embodiments are listed by way of example and should not be construed as a limited list of possible display membrane configurations. Rather, any configuration of display membranes 3 may be chosen with sound engineering.

With reference again to all of the FIGURES, an alternate embodiment of the subject invention will now be discussed. The display membrane 3, as previously mentioned, may be a flexible display membrane 3, which is to say that the bending of the membrane 3 does not permanently or appreciably affect the display characteristics of the membrane 3. Alternately, the display membrane 3 may be substantially rigid. That is to say that the membrane 3 itself will retain its shape, without regard to backing material, to which the membrane 3 may be adhered to. Any manner of affixing the rigid membrane to backing material and/or removing the rigid membrane 3 and remotely placing the device 1 for continued viewing may be chosen with sound engineering judgment.

With reference again to all of the FIGURES, operation of the subject invention will now be discussed. The display membrane 3 may be communicated to the control circuitry 4. Separately the power source 6 may be communicated to both of the display membrane 3 and control circuitry 4. It is noted that sensor means and communications may also be connected to the device in a manner consistent with the aforementioned methods. As discussed previously, any configuration and/or communication means may be chosen with sound engineering judgment when connecting together the components of the device 1. Subsequently, the device 1 may be preprogrammed with a display message, which may include pictures, video, audio and the like. It is noted that the display message may be specifically tailored for use with a specific article, for example a magazine page. The device 1 may then be placed onto a backing material and subsequently affixed to the subject article. Alternately, the device 1 may be affixed directly onto the article. It is noted at this point that the power source may be previously charged with power before affixing the device 1 to the subject article. The subject article may then be packaged for normal use as is appropriate for each individual type of article. For example, after the device 1 has been affixed to a page of a magazine, the magazine may then be packaged for shipment to the local sales stand. In an alternate embodiment, the article may be an instruction manual for a purchase item wherein the instruction manual may be packaged within the container or affixed upon the container of the purchased item. Continuing, the article may then be opened by the user wherein the display message of the device 1 may be displayed to the user. It is noted that sensor means may cause the device 1 to display the preprogrammed message automatically. Alternately, the device 1 may be activated by a user interface in a manner consistent with the aforementioned description. The user may then remove the device 1 from the article and place the device 1 in a different location for continued display. Alternately, the device 1 may be preprogrammed to automatically periodically display a preprogrammed message without activation by the sensor means or user interface. That is to say that the control circuitry 4 may be preprogrammed to display a preprogrammed message at predetermined intervals. It is noted that any manner of displaying the preprogrammed message may be chosen with sound engineering judgment.

In another embodiment of this invention, the device 1 has communications capabilities. In one embodiment, the device can communicate with other devices via radio communication, or other means of wireless communication. This enables the device 1 to communicate with other similar devices in the general vicinity. For example, the devices 1 in a store would have means for communicating with each other. The operation of the communication devices within device 1 are well known in the art, and will not be further described herein.

Figure 7:
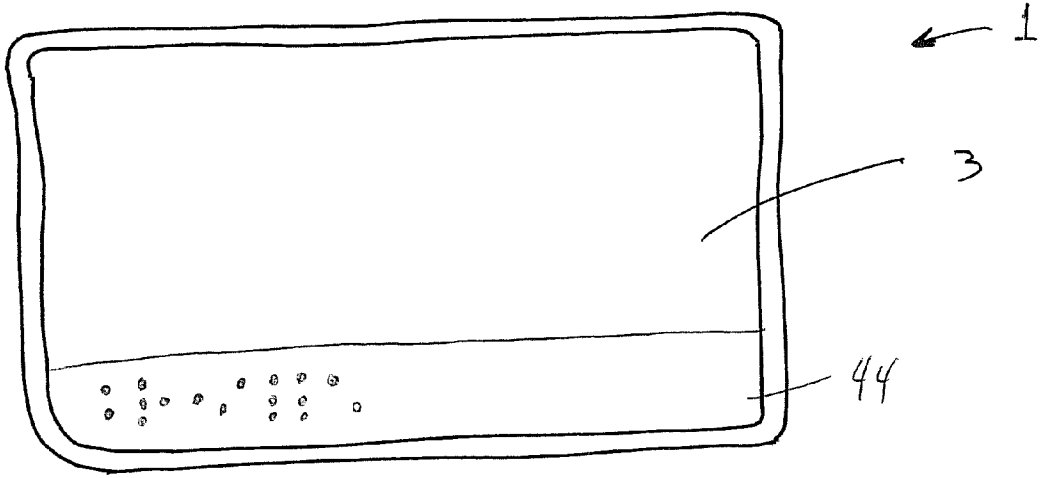
FIG. 7 is a plan view of an alternate embodiment of the flexible electronic display; and, FIG. 7*a* is side view of FIG. 7.
Figure 7A:
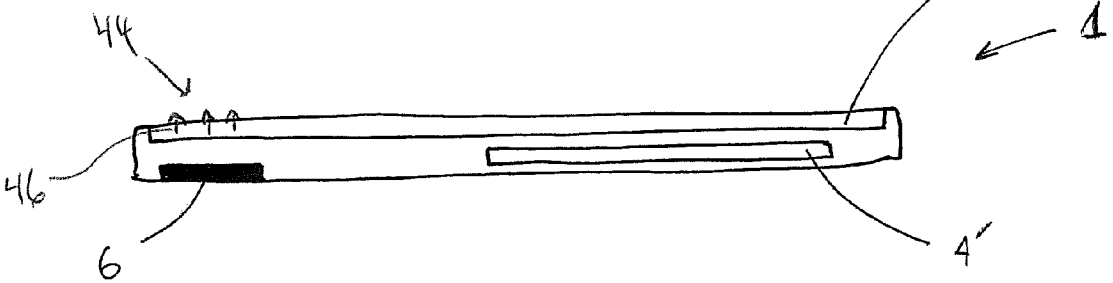

In another embodiment, the device 1 (as shown in FIGS. 7 and 7*a*) has a tactile display 44, which can be Braille, or some other form of information. Either a portion of the display membrane 3 (as shown in FIG. 7) or the entire display membrane 3 is dedicated to the tactile display 44. The tactile display 44 will be either dynamic or static. The tactile display 44 is comprised of multiple contact elements, wherein under each contact element is an electromechanical device 46 that allows the contact element to be raised upon the application of an appropriate electrical signal.

In still another embodiment, the device 1 has a programmable touch interface 4'. In this embodiment, instead of an electrical connector, electrical contact is made to the device 1 through physical contact. In this embodiment, the interface 4' communicates through a wire, via a bit-serial connection, with the necessary protocol to decide which device is communicating when and how. An example of the technology being described herein is the iButton® and 1-Wire® available from Maxim Integrated Products of Sunnyvale, Calif.

In another embodiment of the invention, the device 1 has access to a computer network, which access can be either via a physical connection, or through wireless connection. The wireless connection also allows the device 1 to be connected to other devices, such as a printer, a camera/web cam, speakers, telephones, personal digital assistants, and receive audio transmissions such as radio or satellite radio, etc. In one embodiment, the device 1 could be used to send information directly to a user's PDA. The device 1 can also be used to download information from the global computer network to another device.

In another embodiment of the invention, the device 1 can determine its physical location by accessing a physical location determination system (such as a Global Positioning System or the Galileo system), which can be either via a physical connection, or through wireless connection. Furthermore, the device 1 can relay its position when queried via a suitable mechanism, such as receiving a specific radio signal. This information relay can be either via a physical connection or through a wireless connection.

Several embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

We claim:

1. A method of displaying electronic graphical information in a magazine, the steps comprising:

providing one or more adjacent flexible pages bound together at a binding;

providing a flexible self-contained electronic graphical information displaying means, the self-contained electronic graphical information displaying means including:

an electronic image display device;

control circuitry operatively communicated to the electronic image display device for use in electronically displaying graphical information on the electronic image display device;

at least a first power cell operatively communicated to the control circuitry for use in supplying power to the control circuitry; and, at least one item chosen from the group comprising: headphone port, tactile display, touch interface, means for connecting to a computer network, means for wireless connection to remote devices, means for receiving information from a physical location determination system, means for transmitting information received from the physical location determination system, and a memory port;

affixing the electronic image display device to at least one of the flexible pages; and, selectively displaying at least a first electronic image on the electronic image display device.

2. The method of claim 1, wherein the step of providing a flexible self-contained electronic graphical information displaying means, the self-contained electronic graphical information displaying means further comprising:

providing a sensor for use in determining the proximity of the one or more adjacent flexible pages; and, wherein before the step of selectively displaying at least a first electronic image on the electronic image display device, the step further comprising:

sensing the turning of a flexible page adjacent to the electronic image display device.

3. The method of claim 1, further comprising the step of:

affixing the control circuitry to the binding.

4. The method of claim 1, further comprising the step of:

affixing the control circuitry to one of the flexible pages.

5. The method of claim 2, wherein the step of providing a flexible self-contained electronic graphical information displaying means further includes:

providing electronic information storage means;

selectively communicating the electronic information storage means to the control circuitry; and, preprogramming the electronic information storage means with at least one electronic graphical image.

6. The method of claim 5, wherein the step of providing a flexible self-contained electronic graphical information displaying means, the self-contained electronic graphical information displaying means further comprising:

an electronic data receiving port operatively communicated to the control circuitry; and, further comprising the step of:

selectively operatively communicating the electronic information storage means to the control circuitry, and, programming the electronic information storage means with at least one electronic graphical image, via electronic data receiving port.

7. The method of claim 1, wherein the self-contained electronic graphical information displaying means is selectively, removably attached to the flexible pages, such that the electronic image display device is still capable of displaying the electronic graphical information when removed.

8. The method of claim 5, wherein the method further comprises the steps of:

preprogramming the electronic information storage means with at least one electronic graphical image; and/or re-programming the electronic information storage means with at least one different electronic graphical image.

9. The method of claim 1, wherein the method further comprises the steps of:

determining a position of the device by accessing a physical location determination system; and, altering the electronic graphical information in accordance with the position of the device.

10. The method of claim 1, wherein the means for receiving information from the physical location determination system is a wired or wireless receiver.

11. The method of claim 1, wherein the method further comprises the step of:

displaying information received from the physical location determination system.

12. The method of claim 1, wherein the method further comprises the step of:

adding or removing electronic graphical information via the memory port.

13. A self-contained electronic graphical information displaying apparatus, comprising:

a thin, flexible electronic image display device fixedly attachable to an associated device;

electronic control circuitry operatively communicated to the electronic image display device;

at least a first power cell operatively communicated to the electronic control circuitry for use in supplying power to the electronic control circuitry, wherein the electronic image display device, circuitry, and power cell are contained within one housing, wherein the apparatus is selectively removable when attached to the associated device; and, at least one item chosen from the group comprising: headphone port, tactile display, means for connecting to a computer network, touch interface, means for wireless connection to remote devices, means for receiving information from a physical location determination system, means for transmitting information received from the physical location determination system, and a memory port.

14. The apparatus of claim 13, wherein the control circuitry and the power cell are flexible.

15. The apparatus of claim 14, further comprising:

electronic information storage means being selectively removable with respect to the electronic control circuitry;

user interface means operatively communicated to the electronic control circuitry; and, sensor means for use in determining the proximity of at least a first flexible page with respect to at least a second flexible page on an associated magazine, wherein the apparatus is selectively, removably attached to the magazine.

16. The apparatus of claim 15, further comprising:

audio transmitting means operatively communicated to the electronic control circuitry, wherein the control circuitry is programmed to, at predetermined intervals, transmit audio signals or video images.

17. The apparatus of claim 13, wherein tactile display comprises:

multiple contact elements; and, electromechanical device, wherein the electromechanical device pushes the contact element upward in response to an electronic signal.

18. The apparatus of claim 17, wherein the electronic graphical information is alterable with a change in position of the image display device, as determined by the physical location determination system.

19. A method of displaying electronic graphical information in an associated magazine having one or more associated pages, the steps comprising:

providing a thin, flexible self-contained electronic image display device, the device including:

a flexible electronic image display;

flexible control circuitry operatively communicated to the electronic image display for use in electronically displaying graphical information on the electronic image display;

at least one item chosen from the group comprising: headphone port, tactile display, means for connecting to a computer network, touch interface, means for wireless connection to remote devices, means for receiving information from a physical location determination system, means for transmitting information received from the physical location determination system, and a memory port; and, at least a first flexible power cell operatively communicated to the control circuitry for use in supplying power to the control circuitry;

preprogramming the electronic image display device with at least a first preprogrammed electronic graphical information message;

affixing the electronic image display device to the at least a first associated page; and, displaying the electronic graphical information message on the electronic image display device.

20. The method of claim 19, wherein the step of displaying the electronic graphical information message on the electronic image display device, includes:

automatically displaying the electronic graphical information message on the electronic image display device; and, selectively removing the electronic image display device from the associated magazine, such that the electronic image display device is still capable of displaying the electronic graphical information.

21. The method of claim 20, wherein the step of providing a thin self-contained electronic image display device, includes:

providing a thin self-contained electronic image display device having a user interface receiving associated user input; and, further comprising the step of:

automatically displaying the electronic graphical information message on the electronic image display device responsive to the input from the user interface means.

* * * * *